United States Patent [19]

Harlan et al.

[11] Patent Number: 4,903,825

[45] Date of Patent: Feb. 27, 1990

[54] HOLDER FOR ENCASED COLLECTOR'S COINS

[75] Inventors: Sven Harlan; Ernest A. Verina, both of Norwalk, Conn.

[73] Assignee: 21st Century Coin Products, Inc., Norwalk, Conn.

[21] Appl. No.: 361,639

[22] Filed: Jun. 5, 1989

[51] Int. Cl.[4] ..... A45C 11/28

[52] U.S. Cl. ..... 206/0.8; 206/44 R

[58] Field of Search ..... 206/0.8, 44 R, 0.82, 206/0.83

[56] References Cited

U.S. PATENT DOCUMENTS

| | | | |
|---|---|---|---|
| 2,752,724 | 7/1956 | Carpenter | 206/77.1 |
| 3,412,846 | 11/1968 | Spadaro | 206/0.8 |
| 3,635,335 | 1/1972 | Kramer | 206/0.82 |
| 3,957,157 | 5/1976 | Therrien | 206/0.8 |
| 3,964,829 | 6/1976 | Munis | 206/0.8 |
| 4,165,573 | 8/1979 | Richards | 206/0.8 |
| 4,402,399 | 9/1983 | Friess | 206/0.8 |
| 4,592,465 | 6/1989 | Stein | 206/0.83 |
| 4,762,512 | 8/1988 | Divnick | 206/0.8 |

*Primary Examiner*—Joseph Man-Fu Moy

*Attorney, Agent, or Firm*—Norman B. Rainer

[57] ABSTRACT

A storage device and system are provided for retaining a number of collector's coins that are encased in plastic cases. The coins are retained in an orderly array and are readily reviewable and removable. The device consists of a panel upon which a number of suction cups are mounted. An assembly consisting of the device holding a number of encased coins can be stored in stack-wise manner with other assemblies in a manner whereby the cases of one assembly are in protective abutment with the rear extremities of the suction cups of the next forward assembly.

5 Claims, 2 Drawing Sheets

HOLDER FOR ENCASED COLLECTOR'S COINS

BACKGROUND OF THE INVENTION

This invention relates to the storage of coins, and more particularly concerns the storage of encased collector's coins in an orderly, secure and easily reviewable array.

Rare coins are a valuable possession and are becoming an increasingly important investment vehicle. In recent years a new industry, grading services, has been created in order to stabilize rear coins as an investment. For a fee, a grading service will examine a coin, grade it, and seal it in a tamper-proof case or "slab" which contains a serial number for the coin as well as its grade. Such encased or "slabbed" coins are a much more liquid asset than a "loose", ungraded coin.

The cases or slabs are fabricated of a transparent plastic such as polyacrylate, and may have various sizes or shapes. A problem for buyers of such encased coins is to find practical storage means which affords some measure of security while permitting easy review or display of the coins. Large sized briefcases are currently available to coin dealers for the protective storage and transportation of large numbers of coins. However, such briefcases are impractical for the average investor having relatively few coins, and where transportation is not an issue. Boxes having a number of specially configured retaining means are also in use by coin collectors, but these require that all the coin-confining plastic cases are of the same size and shape.

It is accordingly an object of the present invention to provide a device and system for storing encased coins in an orderly array.

It is another object of this invention to provide a device and system as in the foregoing object which premits easy addition and removal of coins and enables the coins to be easily reviewable.

It is a further object of the present invention to provide a device and system of the aforesaid nature capable of protectively storing within a relatively compact space a variable number of variously shaped plastic cases that confine coins.

It is a still further object of this invention to provide a device and system of the aforesaid nature of durable construction and amenable to low cost manufacture.

These objects and other objects and advantages of the invention will be apparent from the following description.

SUMMARY OF THE INVENTION

The above and other beneficial objects and advantages are accomplished in accordance with the present invention by a holding device comprising:

(a) a substantially rigid thin panel of rectangular configuration having at least one series of uniformly spaced apertures in a straight line array paralleling a side of said panel, and (b) a suction cup held by each aperture, said suction cups being identical, fabricated as a monolithic structure from a resilient plastic, and comprised of a stem and a conical portion, said stem being inserted into and protruding through said apertures, all said conical portions being disposed to face outwardly from one surface of said panel, causing the protruding portions of said stems to be disposed upon the opposite surface of said panel.

Another aspect of the present invention contemplates an assembly comprised of the aforesaid device having encased coins releasibly held by said suction cups, a number of such assemblies arranged in stacked relationship to form a storage system wherein the protruding portions of the stems of one assembly abut against the encased coins held by the next adjacent assembly.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicated corresponding parts in all the figures of the drawing.

DESCRIPTION OF THE PREFERRED EMBODIMENT

Figure 1:
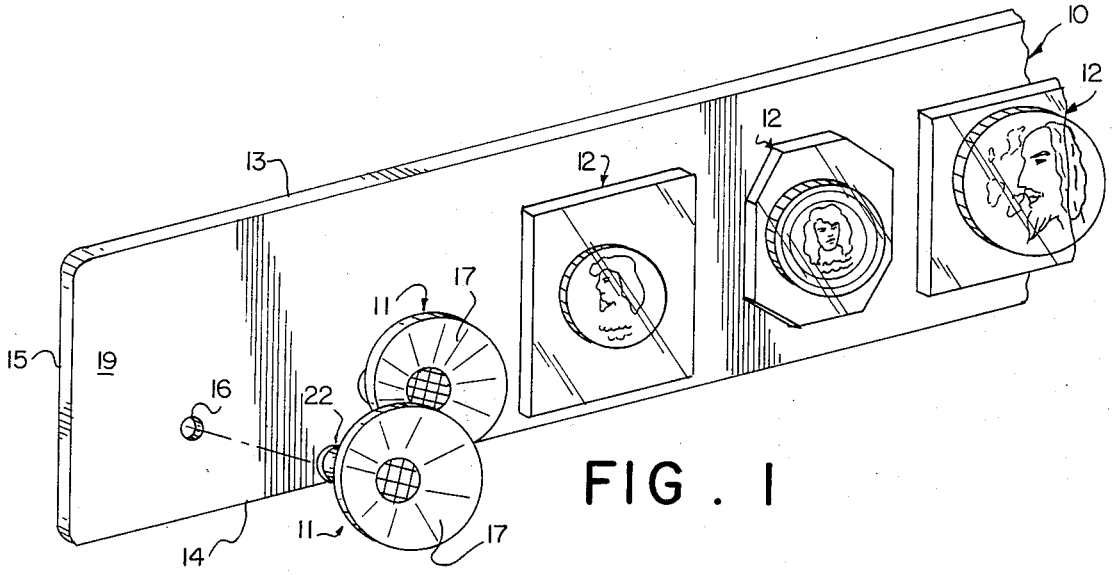
FIG. 1 is a perspective front view of an embodiment of the storage device of the present invention shown in functional association with encased coins.
Figure 2:
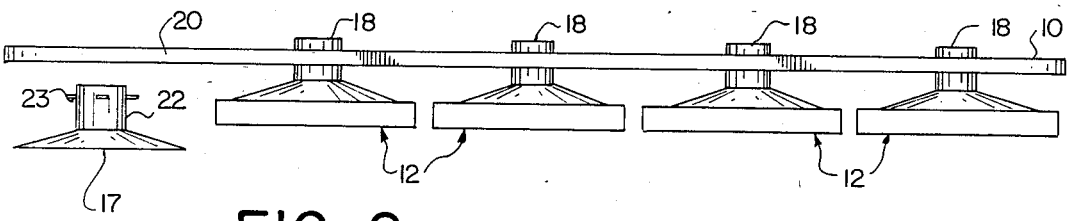
FIG. 2 is a top view of the device of FIG. 1.
Figure 3:
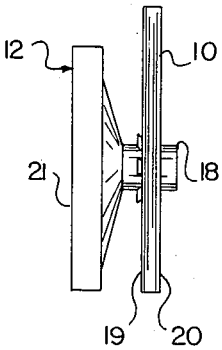
FIG. 3 is an end view of the device of FIG. 1.

Referring to FIGS. 1 through 4, an embodiment of the device of this invention and an assembly derived therefrom is shown comprised of panel 10 holding suction cups 11 which in turn secure coin-containing box-like cases 12.

Panel 10 is of substantially rigid construction, having a thickness between about 1.0 and 4.0 millimeters. The term "substantially rigid" is intended to define a structure which will not bend significantly under its own weight in a direction perpendicular to the plane of the panel, and is further capable of carrying a reasonable load without deforming within the plane of the panel. Suitable panels may be fabricated from plastics such as polyethylene, polyacrylates, polycarbonates, polyamides, polyesters and equivalent sheet-forming thermoplastic polymers. Transparent panels are preferable, although translucent and opaque panels may be utilized, and may contain fibrous reinforcement. The outer perimeter of the panel is rectangular. The dimensions are chosen so that about 4 to 8 encased coins may be held in a single row, and 1 to 7 rows may be accommodated. The illustrated panel is bounded by parallel upper and lower edges 13 and 14, respectively, end edges 15, and front and rear surfaces, 19 and 20, respectively.

At least one series of apertures 16 is disposed in a straight row parallel to edge 13 and extending between end edges 15. When multiple rows of apertures are employed, the apertures of the several rows are disposed in a linear array in the cross-direction, namely between said upper and lower edges.

The suction cups are monolithic structures fabricated from resilient plastics such as plasticized polyvinylchloride having a Shore Durmeter hardness between about 60 and 80. Alternatively the suction cups may be fabricated of soft plastics such as silicones. The suction cups are comprised of a stem 22 of generally circular cylindrical configuration, and a conical portion 17 emergent from the front extremity of the stem. The stem is inserted through said apertures in a manner such that the rear extremity 18 of the stem protrudes beyond the rear surface of the panel, and the conical portions are consequently disposed upon the front surface of the panel.

The stems are accordingly of sufficient length to extend through the panel and protrude beyond the rear surface thereof. The stem is held by the panel primarily by frictional force engendered by the resilient restorative force of the stem reacting from the slight deformation occasioned by its insertion through the aperture. However, projections 23 may be present on the stem which deform sufficiently to penetrate the panel, and then deploy in abutment with the rear surface of the panel. When a coin-holding case is pressed against the conical portion of the suction cup, the case becomes secured for an indefinite duration, forming an assembly comprised of the device of this invention plus the secured cases.

Figure 5:
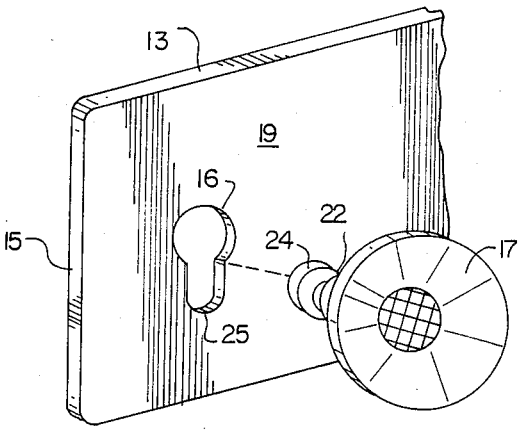
FIG. 5 is an exploded fragmentary perspective view of an alternative embodiment of the storage device of this invention.
Figure 6:
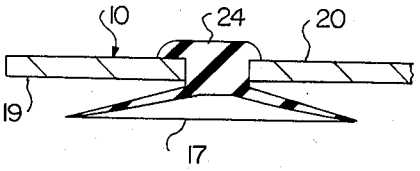
FIG. 6 is a top view of the embodiment of FIG. 5.

In the alternative embodiment of FIGS. 5 and 6, the apertures 16 have a keyhole shape, and the associated suction cups have a button-like shoulder 24 disposed as the rear extremity of stem 22. In use, the shoulder is inserted through the wide circular part of aperture 16, and the suction cup is pulled downwardly, whereby slot 25 of the aperture is caused to grip stem 22.

Figure 4:
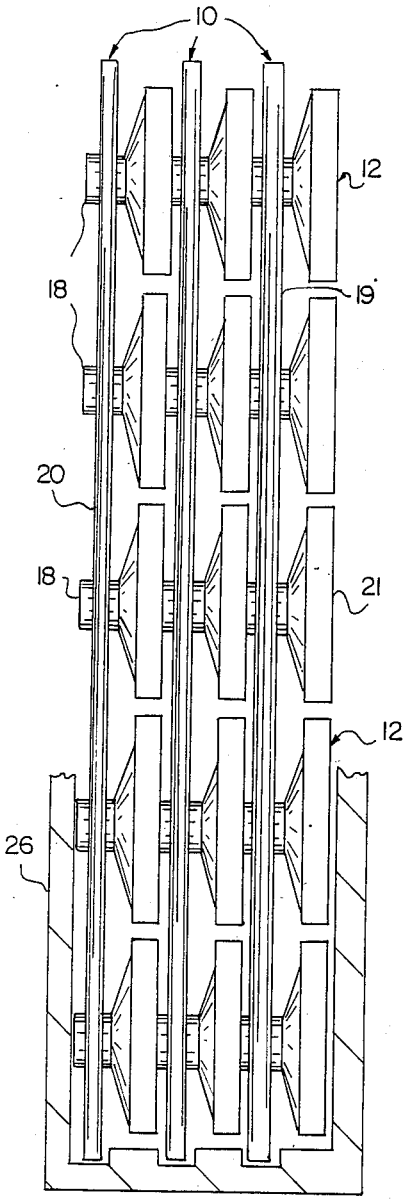
FIG. 4 is a top view of a system comprised of a number of the devices of FIG. 1.

In another aspect of the present invention, a number of said assemblies are arranged in a stacked relationship within confining means such as a loose-leaf binder or suitcase. In such system or stacked arrangement, as shown in FIG. 4, the protruding portions of the stems contact the front faces 21 of the cases held by the next rearwardly adjacent assembly. By virture of such stacking, further protection is afforded the collection of cases within the system. The several assemblies are retained in removable alignment by confining means denoted by numeral 26 intended to represent a suitcase or looseleaf binder.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A device for holding coins confined within plastic cases comprising:

(a) a substantially rigid thin panel of rectangular configuration having at least one series of uniformly spaced apertures in a straight line array paralleling a side of said panel, and (b) a suction cup held by each apertures, said suction cups being identical, fabricated as a monolithic structure from a resilient plastic, and comprised of a stem and a conical portion, said stem being inserted into and protruding through said apertures, all said conical portions being disposed to face outwardly from one surface of said panel, causing the protruding portions of said stems to be disposed upon the opposite surface of said panel.

2. The device of claim 1 wherein the number of series of apertures is between about 1 and 7.

3. The device of claim 1 wherein the number of apertures within a series is between about 4 and 8.

4. An assembly comprising the device of claim 1 and encased coins releasibly held by said suction cups.

5. A storage system comprising a number of the assemblies of claim 4 arranged in stacked relationship wherein the protruding portions of the stems of one assembly abut against the encased coins held by the next adjacent assembly, said assemblies being retained by confining means in removable alignment.

* * * * *